US005549406A

United States Patent [19]

Cohen

[11] Patent Number: 5,549,406

[45] Date of Patent: Aug. 27, 1996

[54] NO-BIND PAGE LIFTER CLIP

[76] Inventor: Abner B. Cohen, 1136 Loxford Ter., Silver Spring, Md. 20901

[21] Appl. No.: 345,417

[22] Filed: Nov. 21, 1994

[51] Int. Cl.[6] ..... B42F 13/00

[52] U.S. Cl. ..... 402/80 L; 402/4; 402/24

[58] Field of Search ..... 402/80 L, 24, 402/80 P, 4, 26, 31; 281/36

[56] References Cited

U.S. PATENT DOCUMENTS

| | | | |
|---|---|---|---|
| Re. 23,708 | 9/1953 | McKowen | 402/24 |
| 1,450,267 | 4/1923 | Trussell | 402/24 |
| 1,451,451 | 4/1923 | Whitlock | 402/24 |
| 1,454,869 | 5/1923 | Trussell | 402/24 |
| 1,904,572 | 4/1933 | Trussell | 402/4 |
| 2,090,231 | 8/1937 | Raynolds | 402/80 L X |
| 2,160,392 | 5/1939 | Schade | 402/4 |
| 2,184,823 | 12/1939 | Vernon | 402/4 |
| 2,276,987 | 3/1942 | Kengott | 503/80 L |
| 2,505,694 | 4/1950 | Stuercke | 402/80 L |
| 2,639,713 | 5/1953 | McKowen | 402/24 |
| 3,366,118 | 1/1968 | Beyer | 402/80 L |
| 3,493,310 | 2/1970 | Orth et al. | 402/24 |
| 3,591,300 | 7/1971 | Beyer | 402/80 L |
| 4,573,822 | 3/1986 | Allen | 402/80 L |

FOREIGN PATENT DOCUMENTS

| | | | |
|---|---|---|---|
| 1347216 | 11/1963 | France | 402/80 L |
| 82640 | 2/1964 | France | 402/80 L |

*Primary Examiner*—Frances Han
*Attorney, Agent, or Firm*—Chenpatents

[57] ABSTRACT

A page lifter clip attached to the back member of a loose-leaf ring binder prevents the snagging and damaging of pages when the covers of the ring binder are closed. The page lifter clip is made of spring steel or of flexible, resilient plastic. It comprises a clamping arch member for attachment to the back member of a loose-leaf ring binder, clamping jaws for securely holding the page lifter clip in place, and proximal and distal arms which prevent the pages from slipping between the rings and the covers of the ring binder, thereby preventing the pages from being damaged when the ring binder is closed.

17 Claims, 2 Drawing Sheets

NO-BIND PAGE LIFTER CLIP

BACKGROUND OF INVENTION

1. Field of Invention

This invention relates to a page lifter, and more particularly to a clip-on type of page lifter to be attached to a loose-leaf ring binder in order to prevent the snagging and damaging of loose-leaf pages.

2. Prior Art Discussion

Page lifters designed to eliminate the snagging of loose-leaf pages in ring binders are not new. Most of them consist of two identical page-size sheets joined together with a middle portion which is aligned with the back member or spring cover of the ring binder. Each sheet has at least two apertures transverse to the sheet length and are secured to the rings of the binder. On the lifters, there are provided some raised structures which aid the lifting of the pages fitted on the rings. Such structures are shown in U.S. Pat. Nos. 3,493,310, 3,366,118, 4,573,822, 3,306,301, and 2,639,713. A section of this structure is used in U.S. Pat. No. 3,591,300.

It is to be noted that the page lifters of the prior art all need to be secured to the rings of the ring binder. These page lifters are complicated to manufacture and difficult to use.

SUMMARY OF THE INVENTION

In accordance with this invention, a page lifter clip made of resilient material comprises a clamping member conforming to the contour of the cross section of the spring cover, hereinafter referred to as back member, of the ring binder to which the clip is adapted. Two clamping jaws at the ends of the clamping member, hereinafter referred to as clamping arch, snap behind the lateral edges of the back member of the ring binder, firmly affixing the page lifter clip to the back member. Two proximal arms attached to the clamping jaws project upward and towards the center of the clamping arch and terminate with two spaced, opposing curved sections. Two distal arms extend from these curved end sections and project outwardly away from the center of the clamping arch and upwardly from the proximal arms. Two inwardly and downwardly curved end of the distal arms are optionally provided for ease of operation.

The object of this invention is to provide a page lifter clip which is simple and inexpensive to manufacture. Another object is the flexibility of providing clips wherever needed without being limited by the rings as the conventional lifters are. A further object is to provide a page lifter clip which can be used with ring binders having any number of rings and without regard to the spacing between adjacent rings.

These and other objects, as well as the various features and advantages of this invention will become better understood by reading the following detailed description in conjunction with the accompanying drawings.

DETAILED DESCRIPTION OF PREFERRED EMBODIMENT

The object of page lifters in loose-leaf binders is to raise the inner edges of the pages, or the edges having punched holes, away from the bottom section of the rings as the binder is closed so as to prevent the pages from being caught between the rings and the cover and thus from being damaged.

Figure 1:
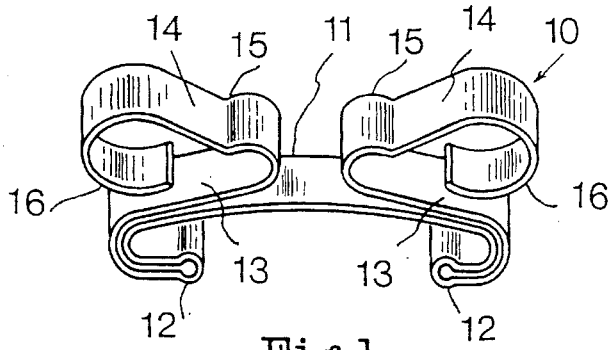
FIG. 1 is a perspective view of the page lifter clip of this invention.
Figure 2A:
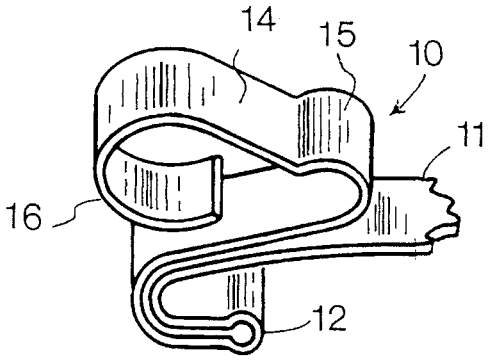
FIGS. 2*a* and 2*b* are fragmentary views showing an embodiment of the clip with the left clamping jaw longer than the right clamping jaw.
Figure 2B:
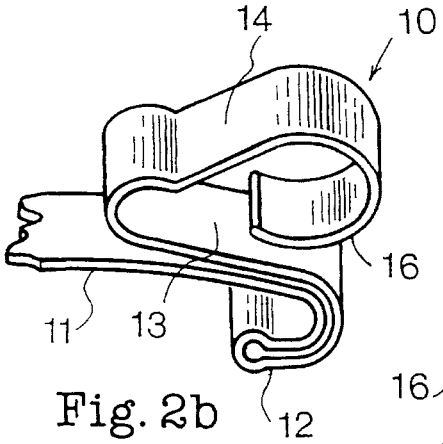
Figure 3:
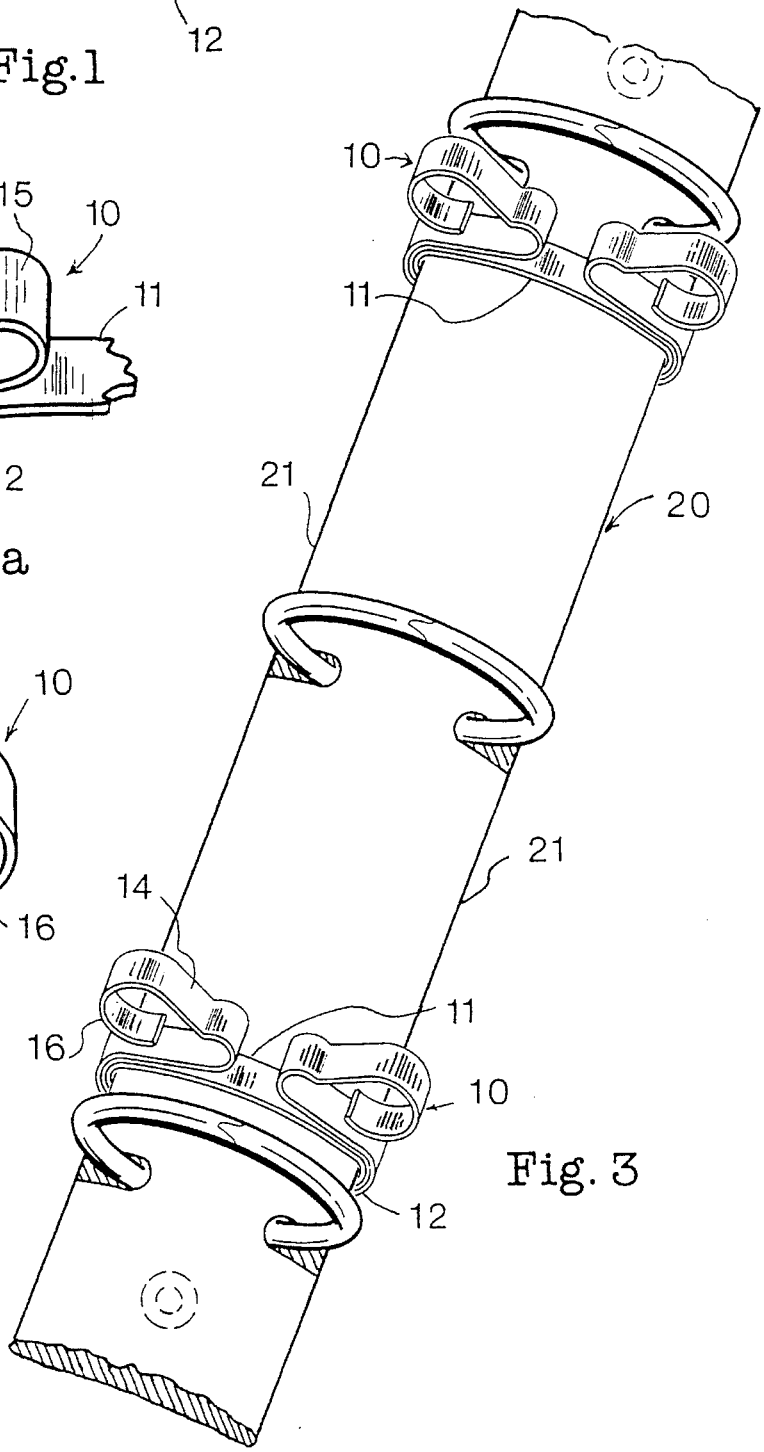
FIG. 3 is a perspective view of two page lifter clips being attached to the back member of a three-ring binder.

Referring to FIGS. 1–3, the preferred embodiment of the page lifter clip of this invention, generally referred to as 10, has a clamping arch 11 curving inward and terminating in two clamping jaws 12. The clip is made of thin, flexible, resilient material such as spring steel or molded plastic, such as polyethylene. The clamping arch 11 is clipped across the back member 20 of a loose-leaf binder 22 at its lateral edges 21. The clamping jaws 12, are the two terminal opposing ends of the clamping arch 11, and by snapping behind the lateral edges 21 of the back member 20 of the ring binder 22, they firmly secure the clip 10 to the back member 20.

Two proximal arms 13 integrally or separately affixed to the clamping jaws 12 project upward and towards the center of the clamping arch. These arms follow contiguously the contour of the jaws and then turn upward above the clamping arch 11 and toward the center of the clamping arch 11, terminating in two outwardly curved sections 15 which are spaced apart to provide room for lateral movement of the sections whose purpose will be explained below. Two distal arms 14, connected to the two curved sections 15 of the proximal arms, project outwardly away from the center of the clamping arch 11, towards and above the clamping jaws 12. The distal arms 14 preferably terminate with two curved ends 16, said ends curving inward and downward towards the proximal arms. Optionally, the distal arms may terminate in any other forms comfortable for grasping, such as blunt ends. It is apparent that when the ends of the distal arms being pressed towards each other, the space left between the two curved sections 15 will allow room for the lateral movement of the distal arms 14 and jaws 12, enabling the installation and removal of the page lifter clip. The proximal and distal arms as well as the curved end sections are made of the same resilient material as the clamping arch and the clamping jaws.

Figure 4:
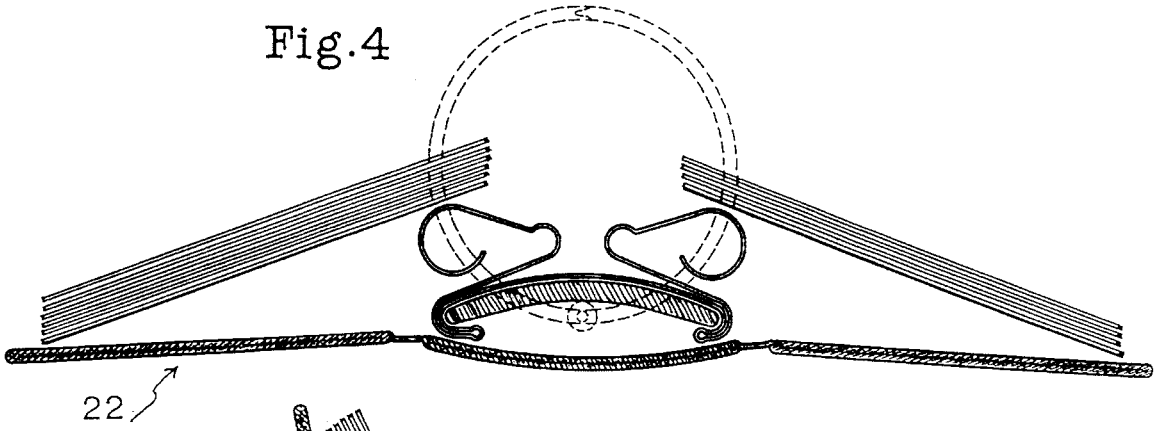
FIG. 4 is a cross-sectional view of the back member of the ring binder with a page lifter clip of this invention attached and the binder in an open position.
Figure 5:
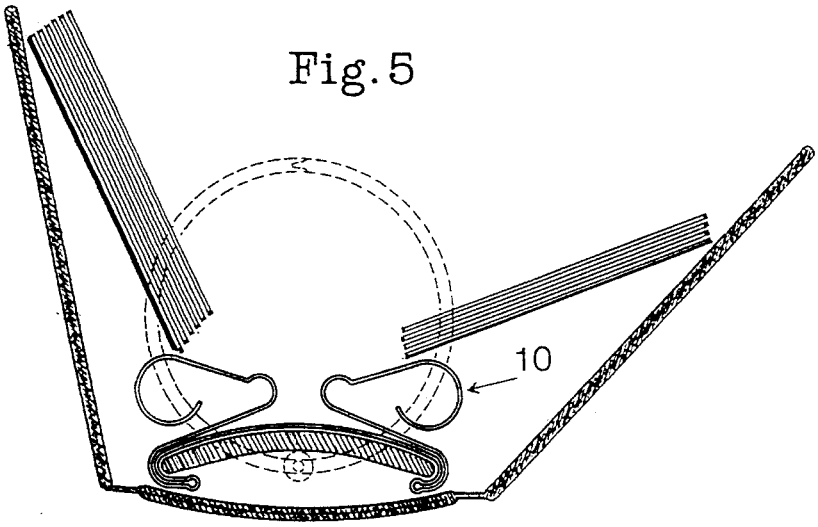
FIG. 5 is a cross-sectional view similar to FIG. 4, with the binder in a partially closed position.
Figure 6:
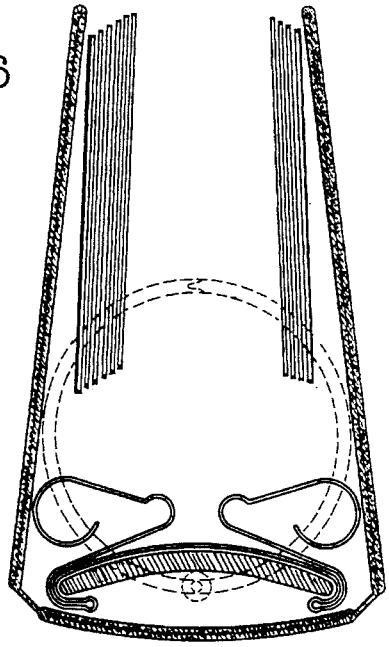
FIG. 6 is a cross-sectional view similar to FIG. 4, with the binder in a closed position.

When the covers of the ring binder are closed, as illustrated by FIGS. 4–6, the pages initially rest on the distal arms, being prevented by the proximal and distal arms of the page lifter clip from sliding into the space between the lower portions of the rings of the ring binder and the covers, thereby being caught and damaged.

In another embodiment, one of the clamping jaws 12 is slightly longer than the other. This is shown in FIGS. 2*a* and 2*b*. A longer clamping jaw is shown in FIG. 2*a* and a shorter one is shown in FIG. 2*b*. The longer jaw is slipped behind the right lateral edge of the back member of the ring binder first, and the shorter jaw is snapped behind the left lateral edge of the back member. This embodiment makes the attachment and detachment of the clip somewhat easier than the one in which both clamping jaws have the same dimensions.

It is readily apparent that at least two page lifter clips will raise the punched-hole edges of the loose-leaf pages to a position on the rings in which these edges cannot be caught between the rings and the covers of the ring binder.

The page lifter clips of this invention are simple to manufacture and easy to use. They may be made in several sizes to fit various width of the back members of standard loose-leaf ring binders, the distance between the clamping jaws ranging from about 10 to 50 mm. The width of the page lifter clips ranges from about 5 to about 25 mm. The thickness of the flexible material of which the page lifter clip is made ranges from about 0.2 to 0.3 mm for spring steel, and from 1 to 3 mm for plastic.

While a preferred embodiment of this invention has been described, it will be readily appreciated that various modifications and alterations can be made therein without departing from the spirit and scope of the invention as set forth in the appended claims.

I claim:

1. A page lifter clip to be attached to a back member of a loose-leaf ring binder comprising:

a clamping arch terminating in two inwardly curved clamping jaws:

a pair of proximal arms, each connected to said clamping jaws and extending above the arch and towards the center of the arch, said arms terminating with two spaced, opposed, outwardly curved sections; and a pair of distal arms connected to said curved sections of the proximal arms, projecting outwardly away from the center of the clamping arch and terminating with two ends.

2. The page lifter clip of claim 1 wherein the ends are curved inwardly and downward towards the proximal arms.

3. The page lifter clip of claim 1 wherein one clamping jaw is longer than the other.

4. The page lifter clip of claim 1 wherein the ends are blunt.

5. The page lifter clip of claim 1 wherein the proximal arms conform to the form of the jaws.

6. The page lifter clip of claim 5 wherein the proximal arms conform contiguously to the form of the jaws.

7. The page lifter clip of claim 1 made of flexible material.

8. The page lifter clip of claim 1 made of spring steel.

9. The page lifter clip of claim 8 wherein the flexible material has a thickness of about 0.2 to 0.3 mm.

10. The page lifter clip of claim 1 made of plastic.

11. The page lifter clip of claim 10 wherein the flexible material has a thickness of about 1 to 3 mm.

12. The page lifter clip of claim 1 having a width of about 5 to 25 mm.

13. The page lifter clip of claim 1, wherein the proximal arms are integrally connected to the jaws.

14. The page lifter clip of claim 1, wherein the proximal arms are separately connected to the jaws.

15. An improved loose-leaf ring binder of the type wherein a back member is affixed on a cover and spaced rings are fixed on the back member for holding pages, the improvement comprising at least two page lifter clips clamped onto the back member between a first and last rings, said clip comprising a clamping arch terminating in two inwardly curved clamping jaws:

a pair of proximal arms, each connected to said clamping jaws and extending above the arch and towards the center of the arch, said arms terminating with two spaced, opposed, outwardly curved sections; and a pair of distal arms connected to said curved sections of the proximal arms, projecting outwardly away from the center of the clamping arch and terminating with two ends.

16. The improved loose-leaf ring binder of claim 15 wherein the ends are curved inwardly and downward towards the proximal arms.

17. The improved loose-leaf ring binder of 15 wherein the ends are blunt.

* * * * *